United States Patent [19]

Ettischer et al.

[11] Patent Number: 4,699,371

[45] Date of Patent: Oct. 13, 1987

[54] SHEET FEEDER

[75] Inventors: Helmut Ettischer, Ostfildern; Heinz-G. Bethmann, Fellbach; Rolf Munz, Kernen; Manfred Radtke, Korb; Friedrich Uffinger, Schorndorf, all of Fed. Rep. of Germany

[73] Assignee: Eastman Kodak Company, Rochester, N.Y.

[21] Appl. No.: 802,636

[22] Filed: Nov. 27, 1985

[30] Foreign Application Priority Data

Nov. 30, 1984 [DE] Fed. Rep. of Germany ... 3443735[U]
Nov. 30, 1984 [DE] Fed. Rep. of Germany ..... 8435143

[51] Int. Cl.[4] ..... B65H 3/08

[52] U.S. Cl. ..... 271/99; 271/127; 271/134; 271/166; 221/9; 221/285; 414/125

[58] Field of Search ..... 271/99, 100, 102, 105, 271/107, 120, 127, 131, 155, 156, 162, 165, 31, 265, 166, 134, 117, 118, 101, 126; 221/9, 285; 177/105; 414/125, 129

[56] References Cited

U.S. PATENT DOCUMENTS

| | | | |
|---|---|---|---|
| 396,594 | 1/1889 | Pellatt . | |
| 1,942,527 | 9/1931 | Winkler et al. . | |
| 3,870,294 | 3/1975 | Donner | 271/3.1 |
| 3,934,868 | 1/1976 | Selak | 271/9 |
| 4,010,944 | 3/1977 | Young | 271/99 |
| 4,014,537 | 3/1977 | Stange | 271/166 |
| 4,219,191 | 8/1980 | Rastorguyeff | 271/3.1 |
| 4,253,654 | 3/1981 | Buys | 271/155 |
| 4,364,549 | 12/1982 | Komossa et al. | 271/165 X |

FOREIGN PATENT DOCUMENTS

| | | | |
|---|---|---|---|
| 2900794 | 10/1979 | Fed. Rep. of Germany | 271/165 |

*Primary Examiner*—H. Grant Skaggs
*Attorney, Agent, or Firm*—Lawrence P. Kessler

[57] ABSTRACT

A sheet feeder includes a supply tray from which the paper sheets are individually withdrawn from the bottom of the stack. The stack supporting bottom of the tray is inclined relative to a horizontal plane, its angle of inclination being adjustable. The inclination of a supported stack can be adjusted according to stack weight or height. The weight of the sheet stack exerting pressure on stack support and/or the sheet separating device can thereby be controlled such that uniform sheet removal conditions are achieved.

6 Claims, 4 Drawing Figures

SHEET FEEDER

FIELD OF THE INVENTION

The invention relates to a sheet feeder for feeding sheets from the bottom of a stack of superposed sheets and more particularly to sheet feeders having a stack supporting surface which is inclined relative to a horizontal plane to facilitate seriatim feeding of sheets from the bottom of the stack.

DESCRIPTION OF THE PRIOR ART

In a sheet feeder having a supply tray for receiving a stack of sheets and from which the withdrawal of sheets is effected from the bottom of the stack, different weight forces depending on height of stack and thus also different withdrawing forces during sheet withdrawal occur. In the case of a tall stack of sheets, the frictional forces between the sheets to be separated and the stack support are high due to the weight of the paper stack so that trouble-free withdrawal of sheets, particularly withdrawal of individual sheets, is not assured.

In order to facilitate handling, it is advantageous to be able to load a tall stack of paper sheets into the supply tray so that it is not necessary to constantly refill paper. Paper refilling can then be effected at longer time intervals.

It is known from U.S. Pat. No. 1,942,527 granted Jan. 9, 1934 to Winkler et al, to arrange a stack of sheets at a fixed angle of inclination so that the weight of the stack of sheets exerted on the stack support is low so as to facilitate sheet withdrawal. Depending on the stack height, the required withdrawal forces for sheet separation vary in strength. In the known device, an additional reduction of the stack weight exerted on the stack support is achieved by means of pressurized air.

SUMMARY OF THE INVENTION

It is the object of the invention to provide a sheet feeder for feeding sheets from the bottom of a stack in which the force required to withdraw the bottom-most sheet is substantially the same regardless of stack height or weight.

According to the invention this is obtained by varying the angle of inclination of the stack support relative to a horizontal plane in accordance with the weight or height of the stack.

In an advantageous embodiment of the invention the angle of inclination of the stack support can be automatically adjusted by a device which detects the stack weight and/or height.

In another advantageous embodiment of the invention the stack support is pivotally mounted and its angle of inclination relative to a horizontal plane is changed by a motor driven pinion which meshes with the teeth of a sector gear mounted in fixed relation to the stack support.

In an advantageous manner, the sheet feeder according to the invention permits the weight of the sheet stack exerted on the stack support to remain permanently low so that during withdrawal of the bottom-most sheet the adjacent sheet will not be removed inadvertently by friction. The reduction of weight exerted on the stack support and achieved by the invention is particularly advantageous if the stack support is provided with an opening for access of a pivotable sheet withdrawing device. In this case, the sheet stack is supported by only a narrow section of the stack support in the proximity of said opening.

Another advantage of the sheet feeder of the invention can be seen in that the inclined stack support, which might complicate refilling of paper, can temporarily be pivoted to a horizontal position facilitating the refill operation, and then be returned to the inclined position facilitating sheet withdrawal.

Other features and advantages will be apparent from the description of embodiments of the invention shown in the drawings and from the claims.

Figure 1:
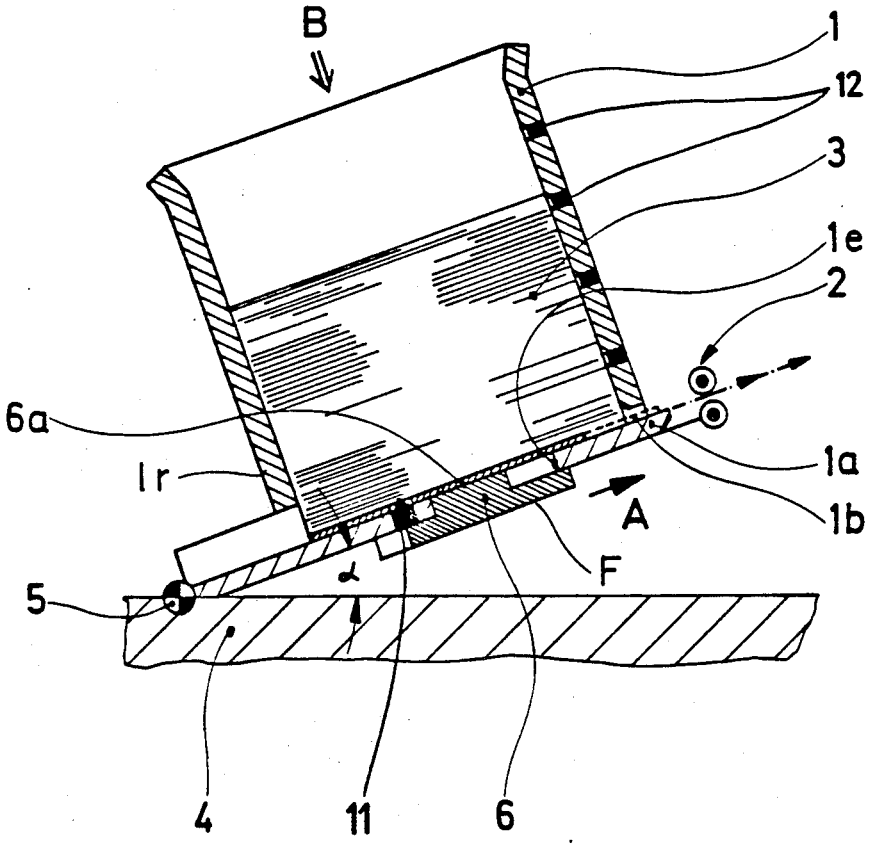
FIG. 1 shows a side view in cross-section of a sheet feeder having an inclined sheet supply tray in accordance with the present invention.

The invention is described in conjunction with a copier, with only the components being shown in the drawing which are required for explaining the invention.

DETAILED DESCRIPTION OF THE INVENTION

A paper tray 1 for the sheet feeder F is mounted for pivotal movement about a fulcrum 5 provided on the frame 4 of a copier. The paper tray 1 has a rectangular cross-section adapted to the paper size and, at its lower side, is provided with a support 1*a* having an opening 1e and to which is mounted a sheet separating device 6 with a plate 6*a*. Plate 6*a* can be transversely coextensive with support 1*a*, but it need be only wide enough to assure withdrawal of the bottom-most sheet of the stack as hereinafter described. The paper tray 1 can be inclined at a suitable angle by means of a device 8, 9, 10 apparent from FIGS. 2 and 3 and described in the relevant parts of the description.

In the direction of sheet feeding movement of plate 6*a* the paper tray 1 has an opening 1*b* through which the paper is withdrawn in the direction of arrow "A".

A pair of transport rollers 2 is arranged outside the tray 1 and connected thereto. The transport rollers 2 are associated with further transport means of a known type, e.g. conveyor belts, which are not shown in the drawing and which form a paper guide path to a processing station, said path being adaptable to the angular position of paper tray 1.

The sheet separating device 6 is designed as a reciprocating component having a plate 6*a* to cooperate with the lowermost sheet of the paper stack. Plate 6*a* is provided with openings (not shown), which can be connected to a vacuum source (not shown) to facilitate sheet withdrawal from the tray 1.

As will be described hereinafter, the paper tray 1 is adjusted to an angle of inclination $\alpha$ at which a predetermined sheet withdrawal force is reached permitting a failsafe removal of individual sheets.

The sheet feeder F operates as follows:

Tray 1 is loaded with a stack 3 of superposed sheets. The height and/or weight of the stack can be visually checked, for example, on a dial or scale (not shown) on tray 1. Alternately, measuring of the stack height can for example be effected by means of infrared reflective switches 12 of a known type (not shown in detail) a plurality of which are arranged in superposed relation in a lateral wall of paper tray 1 as shown in FIG. 1.

If paper tray 1 is to be inclined in response to stack weight, a stack weight depending sensor 11, e.g. an inductive pressure-sensitive member of a known type which is associated with the bottom surface of the stack, is provided in stack support 1a of paper tray 1. Sensors 11 and 12 are conventional units and produce electrical signals corresponding respectively to the detected stack weight and height. Sensors 11 and 12 are operatively connected via electrical control circuitry (not shown) to motor 8 to change the angle $\alpha$ of inclination of the support 1a in response to the detected weight or height of the stack. The number and location of sensors 11 or 12 utilized will depend upon the structure of the sheet feeder and the sensitivity needed to assure the desired uniformity of withdrawal force in feeding sheets from stacks of different weights and heights.

One of the sensors 11 or 12 produces a signal in response to stack height or stack weight. A value will be displayed according to which the angle of inclination $\alpha$ of paper tray 1 is adjusted. The adjusting procedure can be performed manually by means of a handcrank (not shown) driving a gear such as pinion 9, (see FIG. 2) which meshes with the teeth on sector gear 10 mounted on tray 1. Alternatively, the pinion 9 can be driven by an electric motor 8, for example, a stepping motor. In case of the stack weight being relatively great, paper tray 1 is adjusted to a large angle $\alpha$. As a result, only part of the stack weight exerts pressure on support 1a and plate 6*a* of the sheet separating device 6 whereas the main portion of the weight is supported by the lower part of the rear sidewall 1r of paper tray 1.

Selecting an appropriate inclination of paper tray 1 substantially reduces the pressure exerted by the weight of sheet stack 3 on the bottom-most sheet and on plate 6*a* and this reduces the frequency of inadvertent removal of more than one sheet at a time by the sheet feeder F.

The withdrawal procedure is effected such that proceeding from the position according to FIG. 1 the sheet separating device 6 and plate 6*a* is provided with a vacuum and moved in the direction of arrow "A". The lower or bottom-most sheet of stack 3 is thus withdrawn and fed to the sheet engaging transport rollers 2 which take over its further advancement.

After elimination of the vacuum, the sheet separating device 6 and plate 6*a* is returned to its initial position in a direction opposite to the direction of arrow "A". Then the steps are repeated and the next sheet is withdrawn.

As the sheet stack 3 decreases in height (and weight), the angle of inclination $\alpha$ is reduced. Reduction of angle $\alpha$ may be effected for example in steps, with the angle $\alpha$ having to be small when only a small amount of sheets is left in the tray. This is important because a small stack which is too much inclined becomes instable and does not rest firmly on the stack support 1a and plate 6a. Under such conditions, successful sheet separation and withdrawal are unlikely or inconsistent.

Stack 3 can be refilled any time in the direction of arrow "B", whereby a continuous operation is possible.

A second embodiment is described with reference to FIGS. 2 and 3.

This embodiment uses a different sheet separating device 7, whereas paper tray 1 and its possibility of adjustment correspond to the first embodiment according to FIG. 1.

The sheet separating device consists of an arm 7 which can be pivoted about a pin 7*a* mounted on paper tray 1 and on which a suction device 7 and sheet engaging transport rollers 7*b* are arranged. Transport rollers 7*b* are driven by a motor drive (not shown). Arm 7 is arranged within an opening 1*d* of a stack support 1*a*, can be pivoted toward the bottom-most sheet of the stack by means not shown in the drawing, and pivoted away therefrom in the direction of the arrow "C".

Sheet stack 3 rests on stack support 1*a* which, in the proximity of the free end of arm 7, is formed as a narrow supporting surface 1*c*.

A sector gear 10 is rigidly connected to paper tray 1 and pivots about fulcrum 5.

A pinion 9 which meshes with sector gear 10 is driven by an electric motor 8, e.g. a stepping motor.

Figure 2:
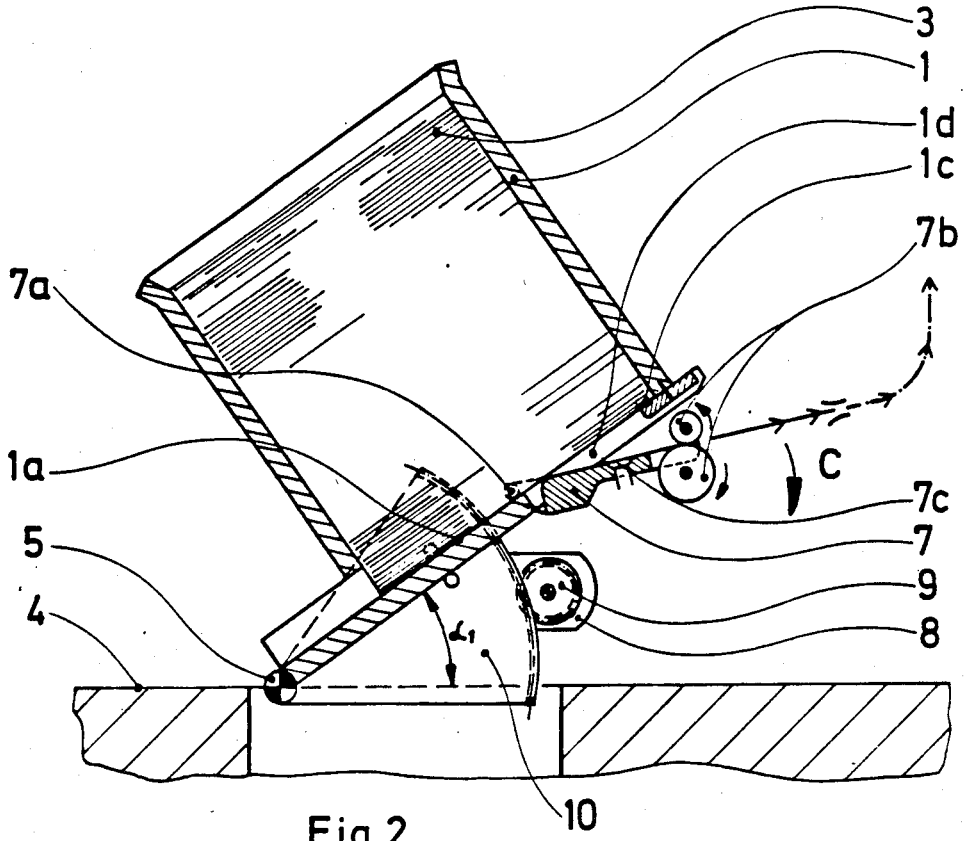
FIG. 2 shows a side view in cross-section of a sheet feeder illustrating a second embodiment of the present invention.
Figure 3:
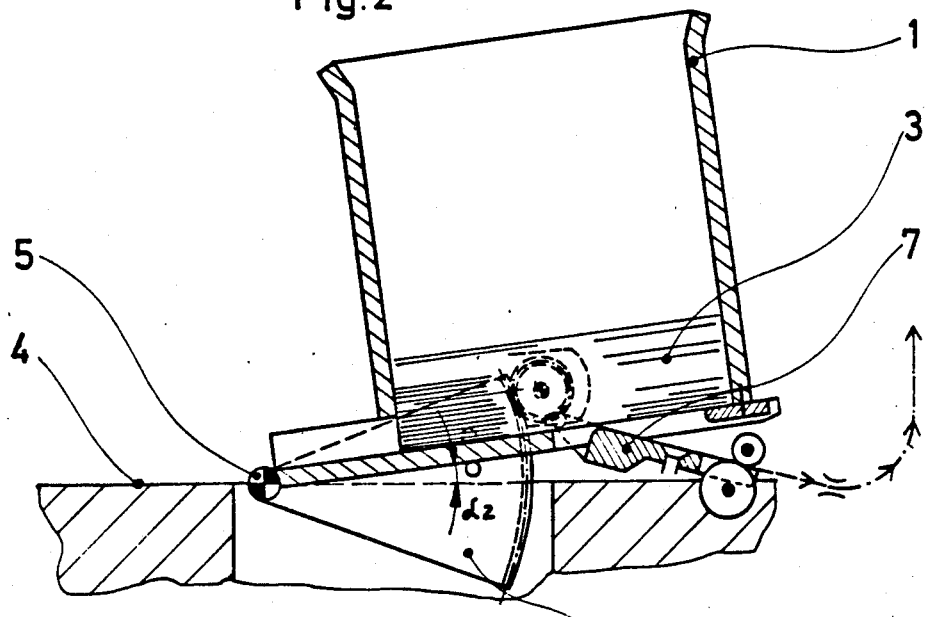
FIG. 3 shows the sheet supply tray of the sheet feeder of FIG. 2 in a different inclined position.

The mechanism according to FIGS. 2 and 3 operates an follows:

Angle $\alpha$ of paper tray 1 is adjusted according to the first embodiment in response to stack height or weight by the rotation of electric motor 8.

The amount of adjustment is determined by sight or in accordance with a weight indicating means. Preferably, the adjustment of angle $\alpha$ is automatically controlled so that a constant pressure of sheet stack 3 on stack support 1*a* is maintained.

Sheet separation is started when arm 7 is pivoted toward the bottom-most sheet of the stack. An end portion of the bottom-most sheet is gripped by suction device 7*c*, which is not described in detail, and withdrawn from sheet stack 3 by pivoting arm 7 in the direction of arrow "C". The sheet to be withdrawn is thereby pulled from the narrow supporting surface 1*c* of stack support 1*a*. Due to the inclined position of sheet stack 3, the weight of sheet stack 3 which normally would exert particularly high pressure on the tray bottom in this area of the narrow supporting surface 1*c* is kept low so that a second sheet is not inadvertently removed by friction.

The individual sheet withdrawn from the stack and pivoted away therefrom is engaged by the transport rollers 7*b* and now completely removed from the bottom of the stack by the drive transport rollers.

When the sheet has left the transport rollers 7*b*, other transport means according to the first embodiment and not shown in the drawing take over further sheet transport.

In lieu of an electric motor for adjusting paper tray 1, a pneumatic or hydraulic drive, for example, can also be used (not shown in the drawing). For the first filling of paper tray 1 or when its inclined position complicates refilling, the support 1*a* of paper tray 1 can temporarily be pivoted to a horizontal position by means of inclining device 8, 9, 10 to facilitate the refilling operation.

Figure 4:
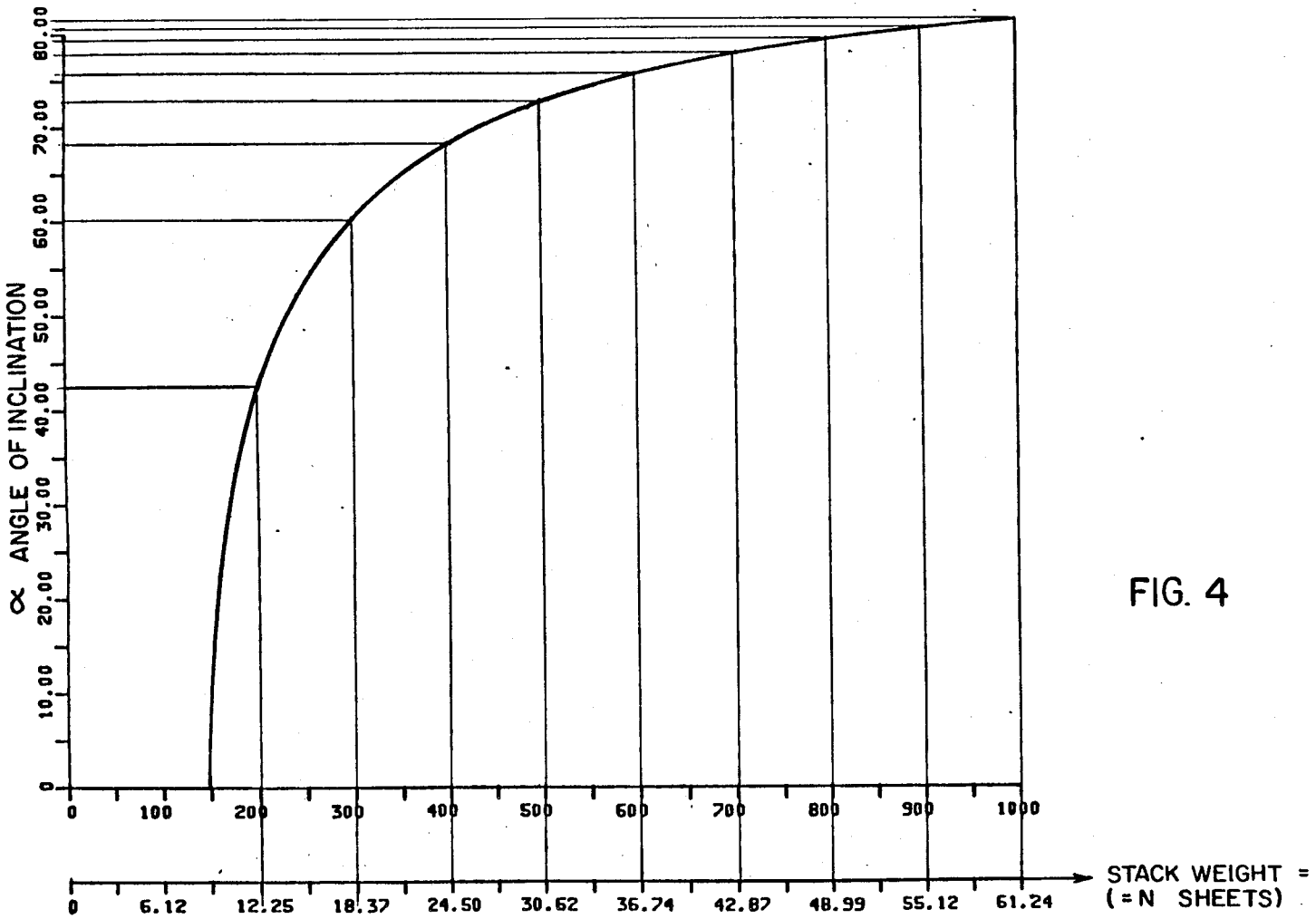
FIG. 4 shows a diagram for the ratio of stack height-/angle of inclination.

A diagram shown in FIG. 4 illustrates the interrelationship between stack weight and respective angle of inclination $\alpha$ of paper tray 1 when the sheet withdrawal force is constant.

The diagram is based on the following values:

Sheet withdrawal force (constant): 5.0 N

Paper weight: 100 g/m$^2$

Paper size: DIN A4

Coefficient of friction paper/support: 0.20

Coefficient of friction paper/paper: 0.35

The individual stack weight values given in the diagram have been associated with the respective numbers of sheets.

It can be inferred from the diagram that in case of a constant sheet withdrawal force of 5.0 N and a high sheet stack 3 having a weight of 61.24 N (=1000 sheets) an angle of inclination $\alpha$ of approximately 82° is to be adjusted.

When the sheet stack 3 decreases, the angle of inclination becomes smaller and will be approximately 73° based on a stack weight of 30.62 N (500 sheets) whereas a stack weight of 12.25 N (200 sheets) is associated with an angle of inclination $\alpha$ of about 42.5°.

While several embodiment of the present invention have been illustrated and specifically described, many modifications and variations are possible and will be readily recognized by those skilled in the art and, therefore, the foregoing description is intended to be illustrative only and the scope of the invention is defined in the appended claims.

I claim:

1. Sheet feeder comprising means for supporting a stack of superposed sheets, means for withdrawing sheets seriatim from the bottom of the stack, and means for varying the angle of inclination of the supporting means relative to a horizontal plane in accordance with the weight of the stack to maintain substantially constant the force required to withdraw the bottom-most sheet regardless of stack weight, said varying means including means for detecting the weight of a stack on said support means and for producing a signal corresponding thereto and means responsive to said signal for establishing said angle of inclination.

2. The invention of claim 1 and wherein said supporting means comprises a bottom and at least one side wall mounted on said bottom substantially perpendicular thereto, and means for pivotally mounting the supporting means about an axis which substantially parallels the intersection of the bottom and side wall.

3. The invention of claim 2 wherein said varying means comprises a gear mounted in fixed relation to the supporting means and a pinion which meshes with the gear whereby rotation of said pinion pivots the support means about said axis and changes said angle of inclination.

4. The invention of claim 2 and wherein said supporting means defines an opening through which said withdrawing means engages the bottom-most sheet of a supported stack.

5. The invention of claim 1 and wherein said supporting means comprises a bottom and two parallel side walls fixed on said bottom at substantially right angles thereto and means for pivotally mounting the supporting means about an axis which substantially parallels the intersection of the bottom and one side wall, the other side wall defining a slot through which bottom-most sheets are withdrawn, and the bottom defining an opening through which said withdrawing means engages the bottom-most sheet of a supported stack to feed such sheet through said slot.

6. The invention of claim 1, and wherein said supporting means comprises a bottom and at least one side wall mounted on said bottom substantially perpendicular thereto, and means for pivotally mounting the supporting means about an axis which substantially parallels the intersection of the bottom and side wall, said supporting means defining an opening through which said withdrawing means engages the bottom-most sheet of a supported stack.

* * * * *